US010974801B2

(12) United States Patent
Puntello

(10) Patent No.: US 10,974,801 B2
(45) Date of Patent: Apr. 13, 2021

(54) STRAIGHTENING EFFECT SAIL

(71) Applicant: Giovanni Puntello, Como (IT)

(72) Inventor: Giovanni Puntello, Como (IT)

( * ) Notice: Subject to any disclaimer, the term of this patent is extended or adjusted under 35 U.S.C. 154(b) by 0 days.

(21) Appl. No.: 16/532,808

(22) Filed: Aug. 6, 2019

(65) Prior Publication Data

US 2020/0047863 A1 Feb. 13, 2020

(30) Foreign Application Priority Data

Aug. 9, 2018 (IT) ..... 1020180008007

(51) Int. Cl.
*B63H 9/061* (2020.01)

(52) U.S. Cl.
CPC ..... *B63H 9/061* (2020.02)

(58) Field of Classification Search
CPC ..... B63H 9/061
See application file for complete search history.

(56) References Cited

U.S. PATENT DOCUMENTS 2,392,165 A * 1/1946 Livingston ..... B63H 25/38 114/162
4,341,176 A * 7/1982 Orrison ..... B64C 3/48 114/102.22
4,843,987 A 7/1989 Samuels
5,799,601 A 9/1998 Peay
2013/0014683 A1 1/2013 Hoyt

FOREIGN PATENT DOCUMENTS

FR 1464877 A 1/1967
WO 2017202858 A1 11/2017

OTHER PUBLICATIONS

Anonymous, "Designer Spotlight: Soft Wing Concept and AC75 Class Rule", North Sails News, Apr. 5, 2018, XP055581212, URL: https://www.northsails.com.

* cited by examiner

*Primary Examiner* — Stephen P Avila
(74) *Attorney, Agent, or Firm* — Cantor Colburn LLP

(57) ABSTRACT

A cruise or race boat sail able to create a straightening effect on the hull that is able to be configured, when used, to take the attitude, with at least a first portion having a first curvature, and at least a second portion having a second curvature, opposed with respect to the first one, where the second portion is the upper portion of the sail and includes at least two superimposed skins that can take different attitudes according to profiles having different curvatures.

2 Claims, 8 Drawing Sheets

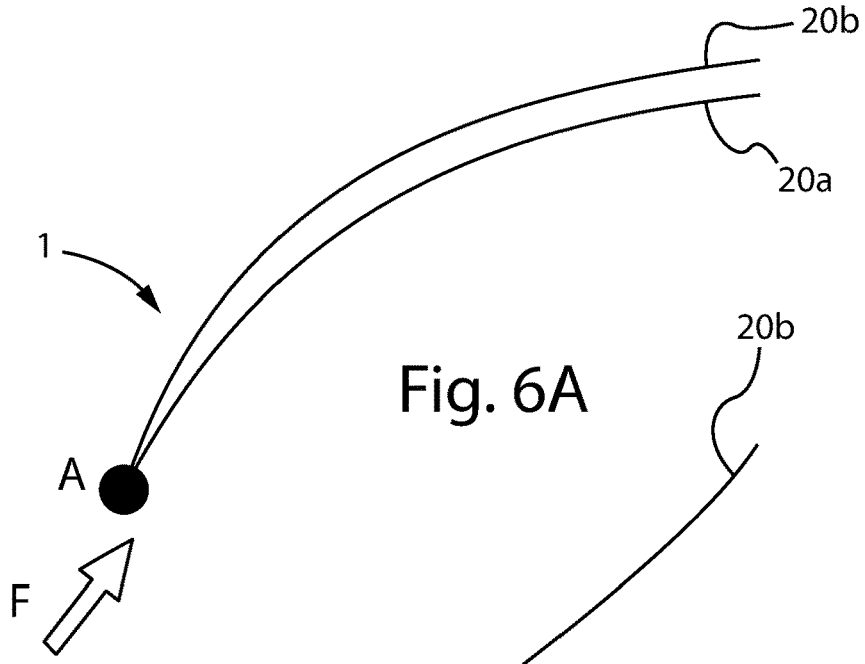
Fig. 6A
Fig. 6B
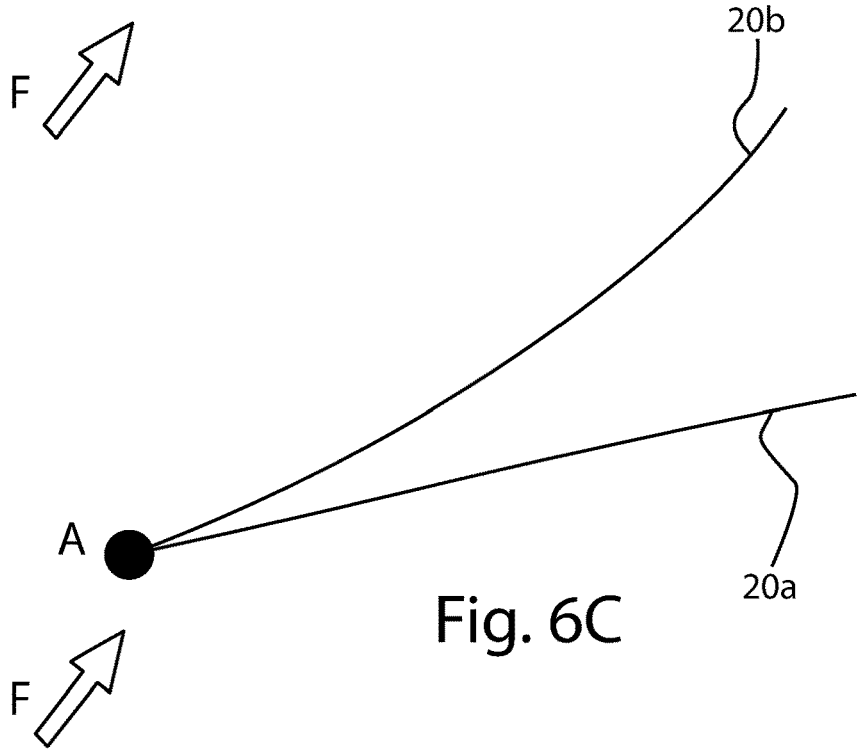
Fig. 6C

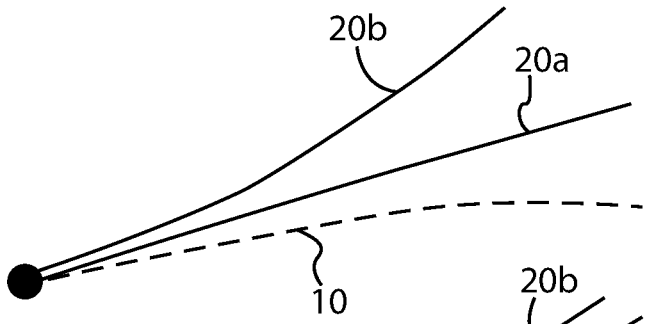
Fig. 6D
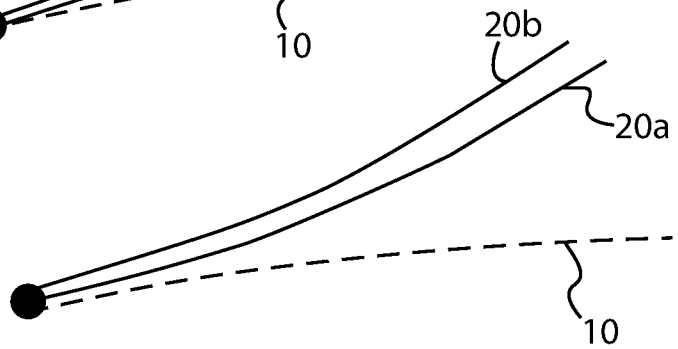
Fig. 6E
Fig. 6F
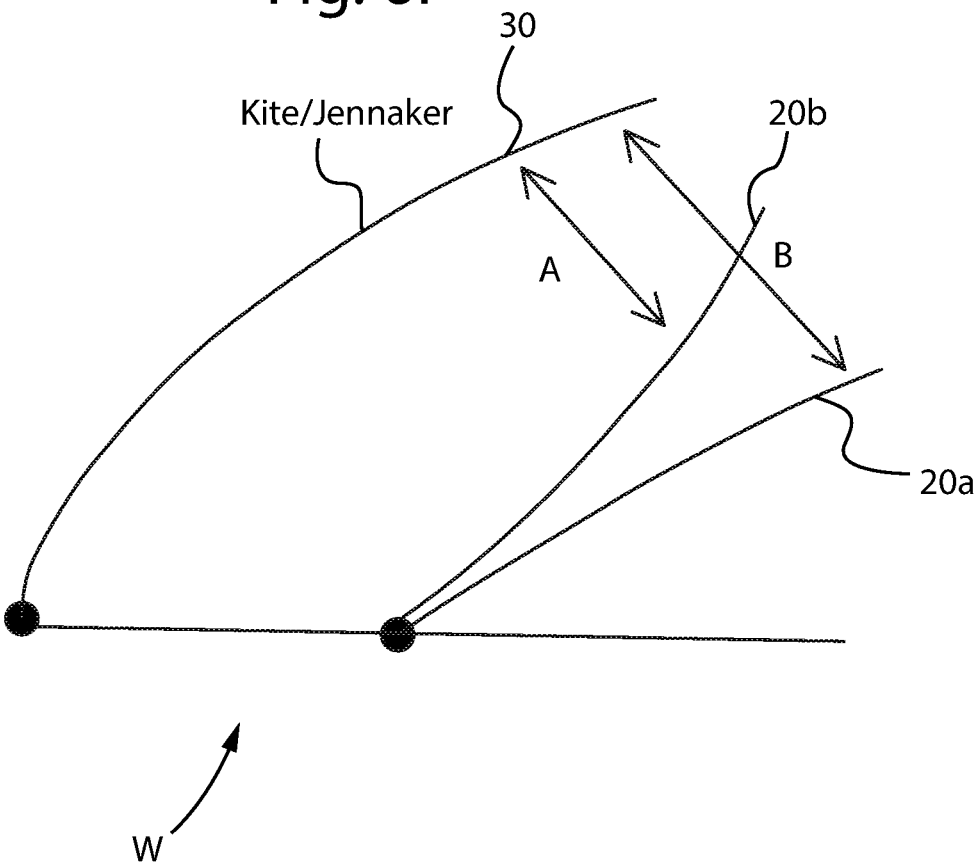

STRAIGHTENING EFFECT SAIL

CROSS REFERENCE TO RELATED APPLICATION

This application is related to and claims the benefit of Italian Patent Application Number 102018000008007 filed on Aug. 9, 2018, the contents of which are incorporated herein by reference in their entirety.

TECHNICAL FIELD

The present disclosure relates to a sail for cruising and racing boats suitable for creating a straightening effect on the hull.

BACKGROUND

To date sails are realized in different materials and the sector evolution involved the use of dacron, kevlar, mylar, as base materials, up to the most modern sails reinforced with carbon fiber and so on.

The evolution of the materials came about in response to the need to give the sail the ability to maintain its shape, without being deformed even in extreme use, and over time.

Two main families exist, namely fabrics and laminates sails. The fabrics sails are generally based on Dacron, the most used material for cruising sails. Laminate, on the other hand, is the composition of several materials to produce a product having desired mechanical characteristics. In a complex laminate, different elements can intervene: a light external Dacron fabric for protection against rubbing and light, inside which can be a Mylar film to stabilize the shape with Kevlar wires or fabrics (rarely) reinforcements, Kevlar being instead the material to which true resistance to loads is assigned.

The shape is decided by the sailmaker based on the characteristics of the boat according to different needs. Generally speaking, a sail is defined by the amount of "fat" portion desired and by its position along a longitudinal direction with respect to the sail (fore-aft direction). What is called trivially fat is therefore the depth of the sail.

On the basis of the fluid dynamics, it is easy to understand how the thicker or "fat" profiles of a sail are suitable for low speeds and thinner, or "thin", profiles are suitable for higher speeds.

A material problem also exists, since Dacron fabrics are less likely to support the shape without deformation compared to more complex laminates. To obtain such a result in racing sails, Dacron is treated with finishes, stiffening them and making them more windproof.

The fat portion of the sail is obtained by working on panel cutting, which are not exactly parallel as it may seem at first sight. Generally speaking, at least four panels are realized to give the shape to a sail, a higher number if the maximum height of the fabric/laminate requires it.

One of the most modern techniques currently used for the realization of a sail without panels is the so called 3DL technique: essentially, a convex mold is prepared and the layer of laminate forming the sail is placed in a single body. In practice, while the laminated material is realized, the shape of the sail is also realized.

An alternative method provides for realizing a laminated flat membrane to which the shape is given with the usual curved cut of the panels. The difference lies in the length of the "threads" that are continuous, and that are interrupted when panels are included.

Besides the materials and the techniques for making the sails, as it is known, the sails are used to obtain a thrust, and when the boat luffs, the wing profile of the sail creates a thrust allowing it to advance, but which also creates a heeling moment tending to make the boat tilt, and which must be counterbalanced by a straightening moment generally generated by a bulb or "foils", i.e. real wings in the most modern boats.

In a simple but effective way, the shape of the sails can be defined by three adjectives: concave (fat), flat (lean) and buckled.

A sail is concave when it has a discreet "belly". The horizontal section of the sail has a "spoon" shape ("a" in FIG. 1).

It is important, for the sake of a good aerodynamic performance of a sail, that the concavity is displaced forward with respect to its center. In fact, by observing FIG. 2, it is clear that the aerodynamic force "F" exerted by the wind on the sail is greater on a concave sail ("Fc") than on a flat sail ("Fp") and that the displacement towards the bow of the concavity also carries with it the forward rotation of the involved force.

Modern sails tend to have an "Fc" shape in the lower part and more and more an "Fp" shape in the upper part towards the head: this is due to the different intensity and direction of the wind in the upper part with respect to the lower part, respectively stronger and with a greater angle (buckling angle) with respect to the longitudinal axis of the boat.

At the same time, however, the thrust on the sail generates, particularly in case of close-hauled, that is when the boat goes toward the wind, a heeling moment, which tends to tilt the boat and makes it drift downwind.

Furthermore, the wind hitting the sail is the apparent wind that is the sum of the real wind (the wind that would hit the boat if it was still) and the advancement wind caused by the speed of the boat itself. With a weak real wind, the advancement wind contributes decisively to the formation of the apparent wind that moves very close to the bow and to the direction of the longitudinal axis of the hull. As the real wind strengthens, its contribution to the formation of the apparent wind increases and the latter approaches the direction of the true wind, moving away from the axis of the hull and thus being redundant.

The friction that the sea surface exerts on the air masses moving above it causes the wind speed to increase as the altitude increases (FIG. 3).

A so called speed gradient is created: between the speed at sea level and that at the height of the mast head (for example: about ten meters) there can be, depending on weather conditions, a difference of 20-30%.

As it is evident, this speed gradient further accentuates the heeling effect.

While advancement speed of the sail is constant at any altitude, it is not true for real wind. In fact, the stronger the real wind is, the more the apparent wind moves away from the axis of the boat, and therefore the sails are subjected to an apparent wind that moves further away from the axis of the boat the more the altitude increases.

For this reason, an optimal adjustment of the sail requires that the same is presented to the wind with an angle that varies according to the height, i.e. the sail must be "buckled" (FIG. 4).

In order to luff avoiding that the boat drifts, and to avoid the heeling of the boat, thrust on the sails must be counterbalanced by the keel, by the bulb or even by foil creating a straightening moment.

To date there is no sail capable of generating a straightening moment.

BRIEF SUMMARY

The present disclosure provides a sail with a straightening effect.

The present disclosure further provides a straightening effect sail, which is simple to realize, and simple to use.

The disclosure also provides a sail with a straightening effect that can be used without the need for particular modifications to the boat, particularly without requiring modifications to the mast and being able to maintain even a single sail luff on the mast.

BRIEF DESCRIPTION OF THE DRAWINGS

Further advantages and features will be more clearly understood from the description of a preferred, but not exclusive embodiment of the sail according to the disclosure, shown for illustrative purposes with the help of the enclosed drawings, wherein:

FIGS. 6A-6C show, in a schematic top view, profiles of the sail skins according to the disclosure with the increase of the wind;

FIGS. 6D and 6E show, in a top schematic view, the curve inversion occurring in the upper sail portion, wherein by the cross-hatched line it has been indicated the lower portion of the sail;

FIG. 6F shows, always in a schematic top view, the curve inversion occurring in the sail upper portion compared with the jennaker curvature;

DETAILED DESCRIPTION

Figure 1:
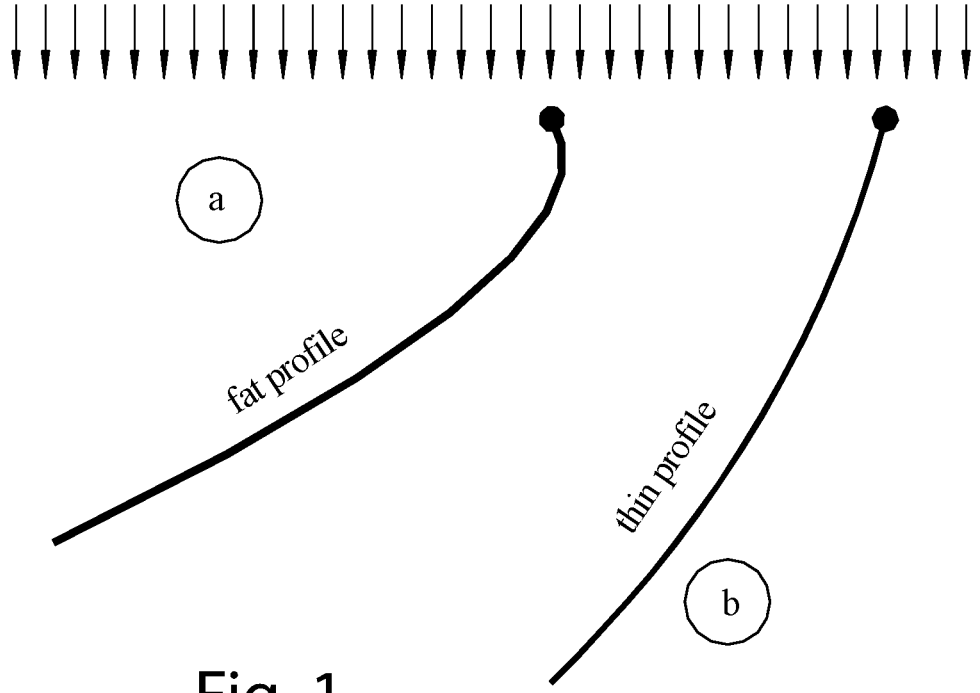
FIGS. 1 and 2 show the general concepts referred to the sail shape and the thrusting action generated by the wind on the sail as a function of the sail shape.
Figure 2:
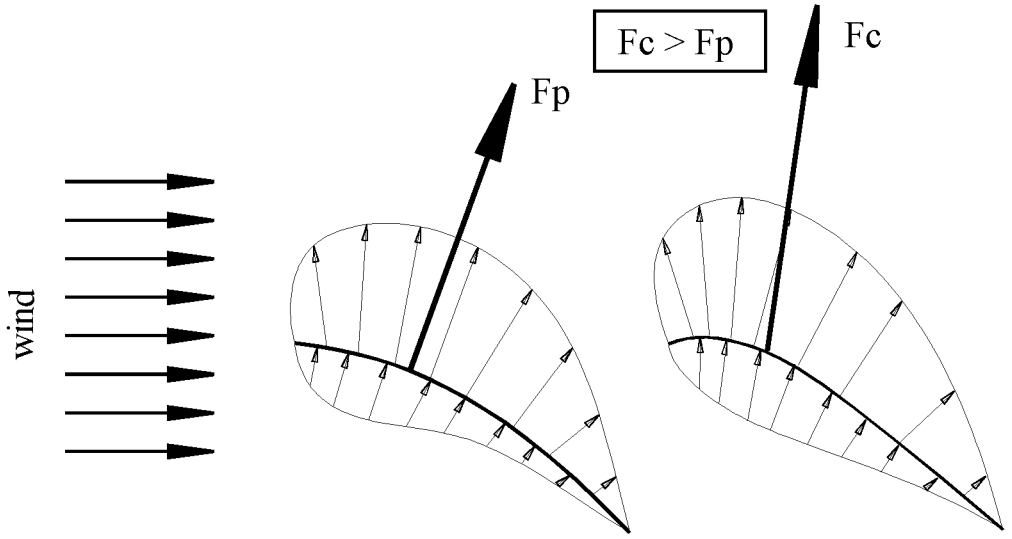
Figure 3:
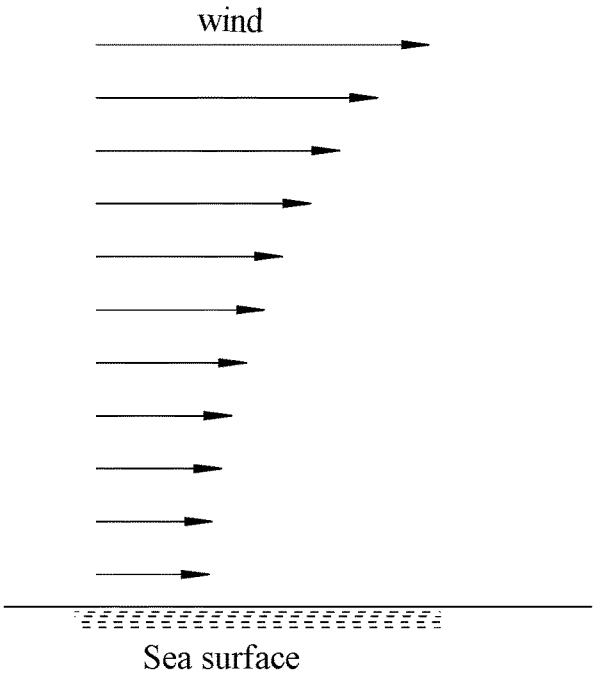
FIG. 3 shows the wind gradient with respect to the altitude.
Figure 4:
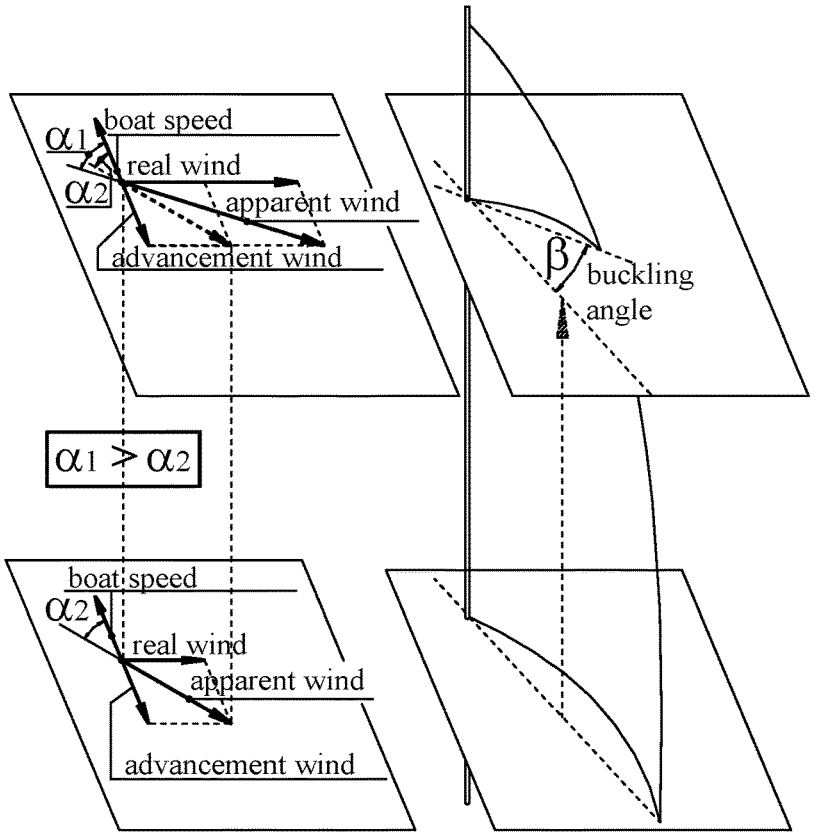
FIG. 4 shows the concepts of true wind, apparent wind, boat speed, advancement wind and sail buckling angle.
Figure 5:
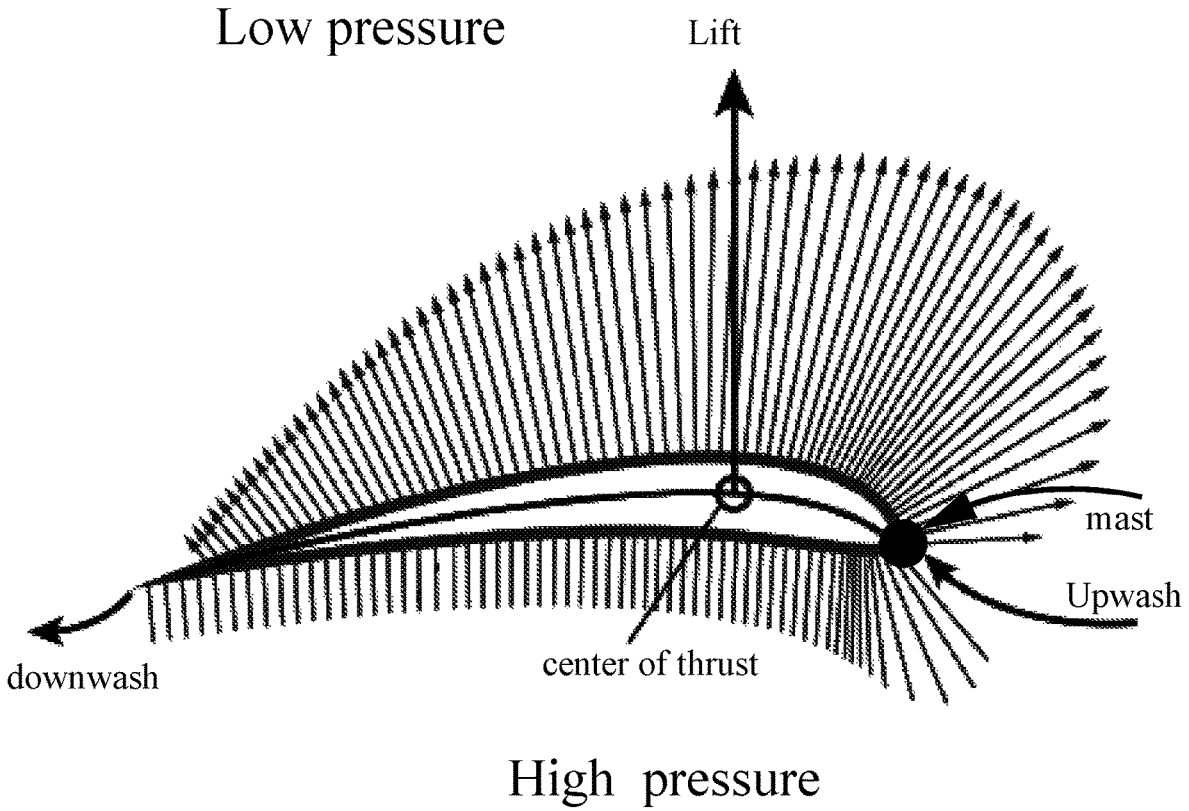
FIG. 5 shows a vector diagram relative to the thrusting force generated on the sail downwind side, and the upwash and downwash concepts.

Referring to the enclosed figures, the straightening effect sail according to the present disclosure, generically indicated by reference number 1, comprises a cruise or race boat sail 1, which, thanks to its particular configuration, has a straightening effect on the boat, effect not present in known sails.

More particularly, sail 1 according to the disclosure is characterized in that it is configured to take an attitude, when used, with at least a first portion 10 having a first curvature, and at least a second portion 20 having a second curvature, opposed with respect to the first one.

Thus the disclosure resides in a sail with a curvature inversion, particularly wherein the curvature inversion occurs in the upper portion of the sail, provided toward the tip of the sail, beyond its half, with respect to the curvature of the lower portion of the sail.

Further, sail 1 according to the disclosure is characterized in that it is configured to take an attitude, when used, with a first portion 10 having a curved wing profile with its concavity faced toward the windward side of the sail, and a second portion 20 having a curved wing profile with its concavity faced downwind the sail.

Thus, sail 1 according to the disclosure can give to the head, i.e. the top vertex of the sail, the capability of generating a straightening moment. The sail head is the most efficient point to apply a straightening force or, as taught by the disclosure, in order to reduce the heeling force.

Thanks to the particular configuration of the sail according to the disclosure, in the downwind zone of the sail a wing profile is realized, particularly in the upper zone of the sail, close to the head, having a concavity opposed with respect to the windward wing profile which, as it will be indicated as follows, could also become a linear profile.

This result is obtained, according to the preferred embodiment of the disclosure illustrated by way of example, due to the presence in the upper part of the sail of two flaps, or fabric skins.

More particularly, a second skin, or layer, of fabric will be advantageously configured to arrange itself according to a curved wing profile in the downwind side of the wing. Said second skin is advantageously distinguished from a first skin that will result, when in use, windward, and will separate in the upper portion, or head, of the sail creating a curve having curvature opposite with respect to the curvature of the windward skin.

Particularly, if the windward sail has a concavity faced towards the windward side of the sail, the second skin that is on the downwind side of the sail can assume a curvature equal to the windward skin, a neutral curvature, or a curvature opposite with respect to that of the windward skin, i.e. with a concavity facing the downwind side of the sail.

Preferably, according to what is here illustrated by way of example, the sail 1 according to the disclosure is characterized in that it comprises a first portion 10 in the lower area of the sail 1, and a second portion 20 in the upper area of the sail 1.

Thus, preferably, the portion in the upper zone of the sail comprises two superimposed skins 20*a*, 20*b*.

More specifically, and with reference to FIGS. 6A to 6C which show a top schematic view of the sail 1, inferred in a mast A, in different wind conditions F, with the same track (thus maintaining the angle of incidence of the wind relative to the sail constant) the sail 1 according to the disclosure, particularly the two skins 20*a*, 20*b* of the upper portion 20 of the sail, may assume different configurations depending on the intensity of the wind.

The upper part of the sail comprising, as already said, two separate skins 20*a*, 20*b*, one windward and the other downwind with respect to the flow, will be arranged according to one of the mode shown in FIGS. 6A to 6C.

Advantageously, both skins 20*a*, 20*b* have the same size (surface), however, while the windward skin 20*a* in the figures normally works like a traditional wing, the downwind skin 20*b* can, under certain conditions, bend differently than the windward one, even exactly in a contrary manner, and depending on its curve, which can be controlled for example by a tensioning mechanism, not shown, it produces a straightening moment on the boat.

Tensioning mechanism can advantageously be for example comprised by a cable connecting the leech of each skins 20*a*, 20*b* to the end of a cross-tree on the corresponding side of the mast.

Overall, in correspondence with the head, as a result of what has been described, there will be a minor thrust effect to the advancement, however mitigated by a more favorable upwash (that is a favorable deviation of the air flow hitting the sail), but the straightening component will be so high, being positioned at the upper end of the sail, i.e. the head, to produce greater efficiency on the overall equation, improving the VMG.

The straightening effect of the sail according to the present disclosure gives an advantage in structural terms in the design of the hull that will be able to take into account a lower heeling force, so that the bulb and/or the foils can be of reduced weight and size.

The downwind skin, in the example of the figures indicated with reference number 20*b*, can be regulated or put under tension in different ways depending on the intensity of the airflow hitting the sail.

By way of example, and with particular reference to FIGS. 6A, 6B and 6C, with low flow intensity regimes, the two curves defined by skins 20*a* and 20*b* are coincident without the downwind skin 20*b* detaching from the windward skin 20*a* forming different curves. In this condition, which for example can occur for wind intensity from 0 to 10 knots and which is shown in FIG. 6A, there is therefore a single curve.

As the wind increases (FIG. 6B, about 10-15 wind knots, and 6C, about 15-20 wind knots) the downwind skin 20*b* can be detached from the windward skin 20*a* giving rise to a downwind thrust creating a straightening moment on the boat which has the effect of increasing the lift and reducing the heeling force.

The innovation produces a straightening effect and in the backwind tracks, it allows to have a sizing (in terms of design and structure or adjustment) of the bulb and the lower foils: the boat also increases its VMG in backwind tracks where the skidding effect will be lower. The described inversion of the curve allows in the backwind tracks both to generate if necessary a straightening moment and to close the channel with the overlapping sails used at these speeds (spinnaker, jennaker, kite and codozero). This effect, illustrated in FIG. 6F, increases the advancement thrust due to the amplitude reduction of the channel created between the jennaker 30 and the mainsail 1, due to the curvature of the downwind skin 20*b* of the same mainsail 1.

As it can be noted, in fact, the downwind skin 20*b* by assuming a curvature opposite with respect to the windward skin 20*a* will define a channel of width A between mainsail and kite/jennaker lower than the width B of the channel defined by the windward skin 20*a*, so as to determine an acceleration of the airflow between the two sails and, therefore, an increase of the apparent wind on the kite/jennaker.

The above causes the increase of the VGM of a boat.

As already said, and with reference to FIGS. 6A to 6C wherein the apparent wind is indicated by F, the configuration of the windward 20*a* and downwind 20*b* curves will vary with the variation of the apparent wind intensity.

FIG. 6A shows a condition of low wind intensity: the curve defined by the windward skin 20*a* is arranged with the concavity facing the windward side of the sail and the downwind skin 20*b* follows the same arrangement.

FIG. 6B shows a condition of average wind intensity: the curve defined by the windward skin 20*a* is still arranged with the concavity facing the windward side of the sail even if it will have a more flattened shape, with a less accentuated concavity, while the downwind skin 20*b* will detach from the upper skin 20*a* by arranging itself with the concavity towards the downwind side, which is therefore opposite with respect to the concavity of the windward skin 20*a*.

Finally, FIG. 6C shows a condition of high wind intensity: the windward skin 20*a* flattens, eliminating or significantly reducing its concavity, while the downwind skin 20*b* will still be offset with respect to the windward skin 20*a* and will be disposed with its concavity towards the downwind side.

FIGS. 6D and 6E schematically show the curvature of the windward skin 20*a* and of the downwind skin 20*b* of the upper portion of the sail in comparison with the curvature of the lower portion 10 of the same sail, schematically indicated with a dashed line.

Figure 8:
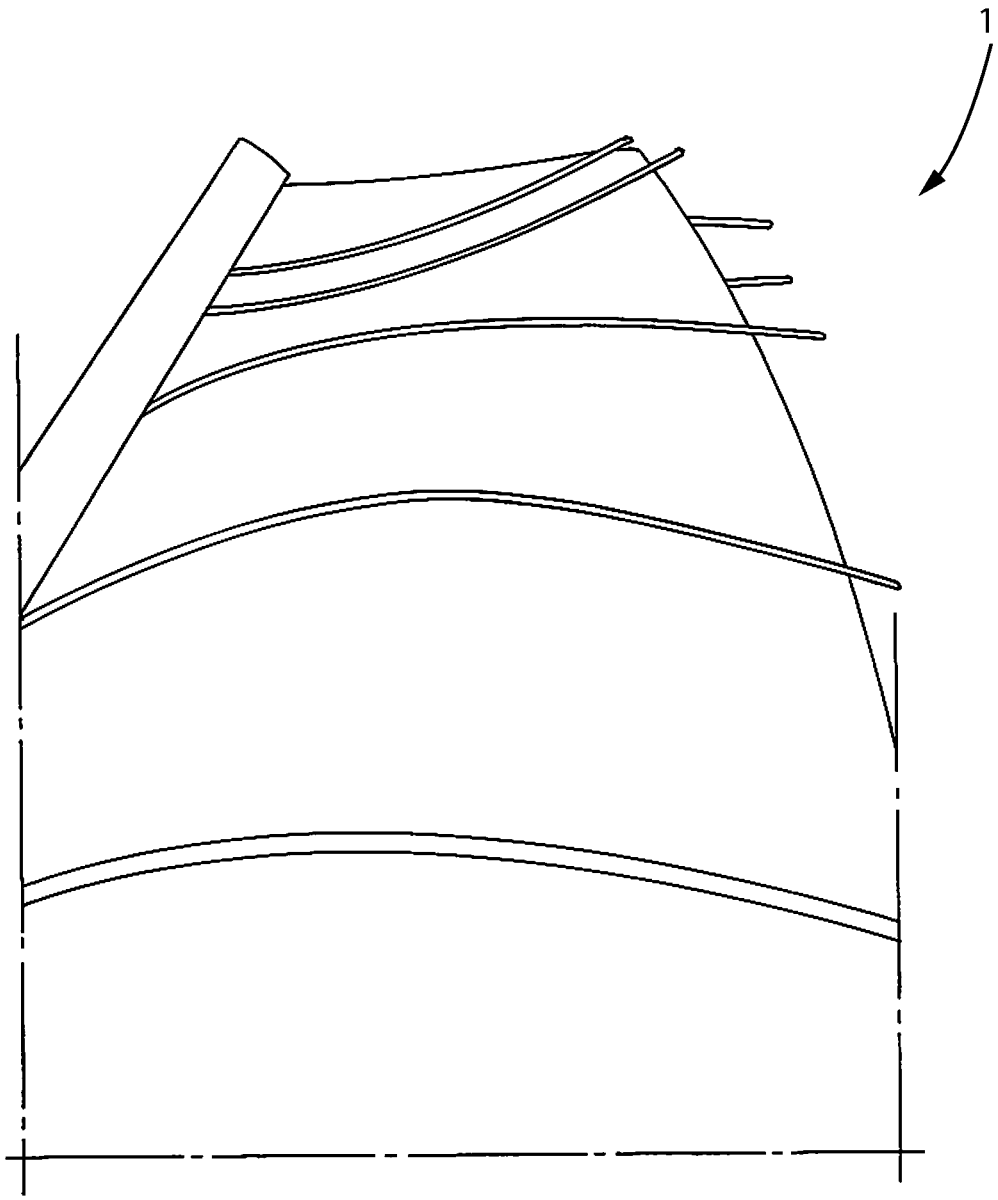
FIGS. 8 and 9 are two bottom views of the sail from which it is noted the inversion of the upper portion of the sail.
Figure 9:
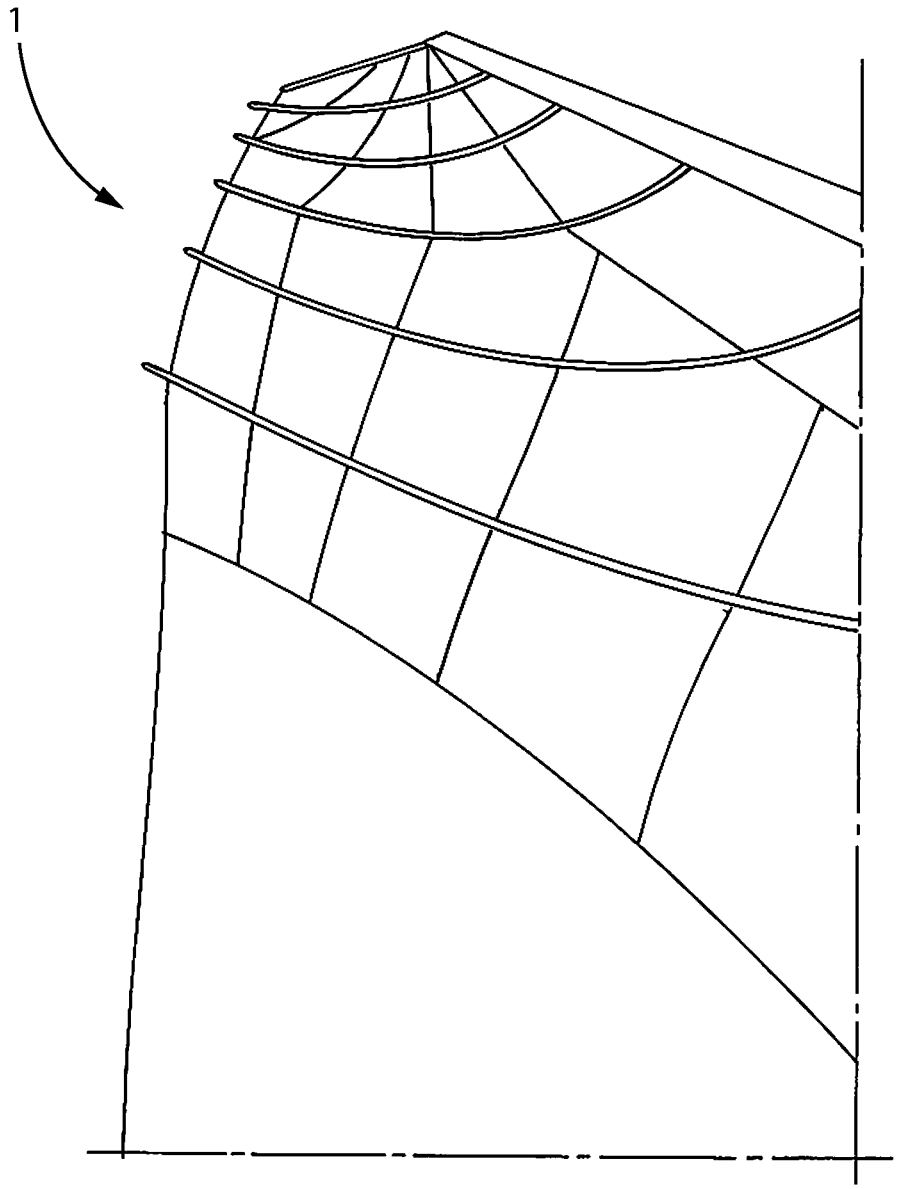

Said different curvature between the lower portion 10 and the upper portion 20 of the sail is also visible in FIGS. 8 and 9, making it possible to appreciate how the upper portion 20 of the sail is arranged according to a curve opposite with respect to the curvature of the lower zone 10.

Advantageously, said skins 20*a*, 20*b* of said second portion 20 of said sail 1 are joined together at least in correspondence of the sail luff 12, i.e. the portion that is inferred in the mast.

The description set forth herein refers particularly to a mainsail, however it is clear to the person skilled in the art that the concepts of the present disclosure can be applied to any type of sail or wing.

Preferably, the skins 20*a*, 20*b* of the second portion 20 of the sail 1 are joined together also at a lower edge 21, which then defines the lower edge of the second portion 20.

Figure 7:
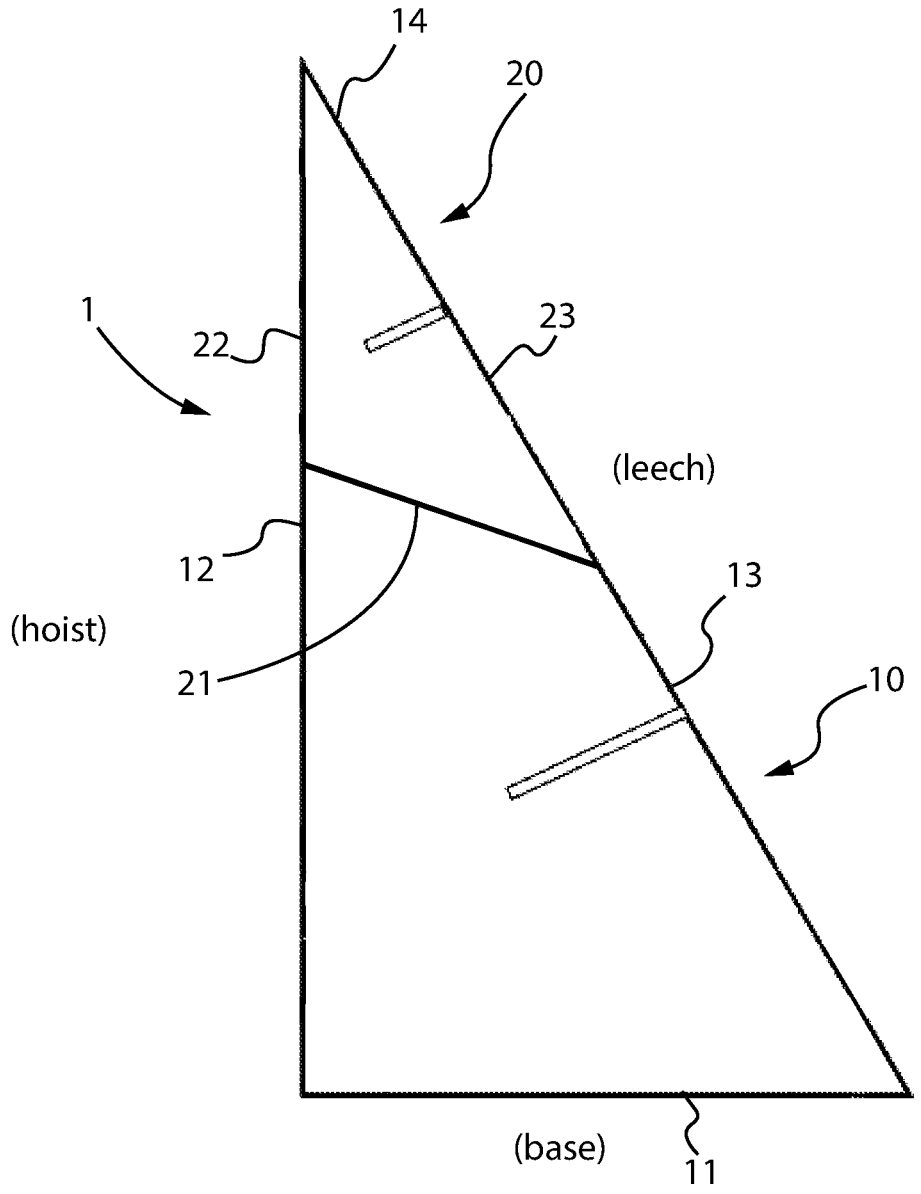
FIG. 7 is a schematic lateral view of the sail according to the present disclosure.

With particular reference to FIG. 7, the sail 1 according to the disclosure thus comprises, in addition to a base 11, a luff 12, a leech 13 and a head point 14, an upper portion 20 which is inferiorly delimited by the lower edge 21 which is preferably inclined with respect to the direction identified by the base 11, which we can be defined as horizontal direction.

Advantageously, the lower edge 21 of said upper portion 20 of the sail 1 is inclined with respect to the base 11 so as to form a shorter portion 22 at the luff 12 of the sail to the mast, and a longer section 23 at the leech 13 of the sail.

Practically, it has been found that the sail according to the disclosure obtains the intended aim and objects, since it is able to provide a straightening moment on the boat.

Another advantage of the sail according to the present disclosure consists in the fact of creating a downwind curve in the part of the sail head that is adjustable, opposite to the curve created by the windward part.

These aims and advantages are obtained by effect of the downwind curve that creates an additional upwash on the windward curve, improving the angle of incidence or the flow entrance.

In this way it is possible to manage two opposite or in any case different curves on opposite walls.

This allows to obtain a wing that altogether produces a thrust, but for a part of the same also a straightening moment, thus allowing to reduce the resistance and to increase the lift and to reduce the heeling force.

The sail according to the present disclosure thus conceived is susceptible of numerous modifications and variations, all of which are within the scope of the inventive concept; furthermore all the details may be replaced by technically equivalent elements. In practice, the materials used, as well as the dimensions, may be any according to the technical requirements.

Practically, the materials used, so long as they are compatible with the specific use, as well as the contingent shapes and dimensions, may be any according to requirements.

The invention claimed is:

1. Straightening effect sail for pleasure or racing boats, comprising a base, a luff, a leech, and a head, said sail being configured to arrange, in a use condition, at least one first portion, provided in the lower area of the sail, having a first curvature, and at least one second portion, provided in the upper area of the sail, having a second curvature, opposite with respect to the first one, wherein said first portion has a curved wing profile with its concavity facing toward the windward side of the sail, and said second portion has a curved wing profile configured to arrange itself, in use, with its concavity facing toward the downward side of the sail, said second portion comprises at least two superimposed skins, wherein said skins of said second portion are intended to be coupled with a mast and wherein said skins of said second portion are joined together at least in correspondence of the lower edge of said second portion of said sail, said lower edge of said second portion of said sail being inclined with respect to the direction identified by said base, so as to define a shorter length section in correspondence of the luff of the sail and a longer length section in correspondence of the leech of said sail, said sail further comprises a tensioning mechanism for adjusting the position of said skins.

2. Sail according to claim 1, wherein said tensioning mechanism comprising a cable connecting the leech of each of said skins to the end of one of the cross-tree of the mast.

* * * * *